United States Patent [19]

Miller

[11] 4,106,515

[45] Aug. 15, 1978

[54] SIDE BURN TRIMMING GUIDE

[76] Inventor: David Miller, 166 Bristol Ferry Rd., Portsmouth, R.I. 02871

[21] Appl. No.: 766,089

[22] Filed: Feb. 7, 1977

[51] Int. Cl.[2] ..... A45D 24/36

[52] U.S. Cl. ..... 132/45 R; 33/174 D

[58] Field of Search ..... 33/174 D, 174 G; 132/45 R, 88.5

[56] References Cited

U.S. PATENT DOCUMENTS

| | | | |
|---|---|---|---|
| 1,355,038 | 10/1920 | Ford | 132/45 R |
| 1,567,011 | 12/1925 | Parziale | 132/45 R |
| 1,585,088 | 5/1926 | Delmon | 132/45 R |
| 2,786,477 | 3/1957 | Cohen | 132/45 R |
| 3,491,450 | 1/1970 | Ayoub | 33/174 D |
| 3,709,234 | 1/1973 | Seerahn | 132/45 R |
| 4,010,764 | 3/1977 | Wagner | 132/45 R |

FOREIGN PATENT DOCUMENTS

| | | | |
|---|---|---|---|
| 725,158 | 3/1955 | United Kingdom | 132/88.5 |

*Primary Examiner*—Richard R. Stearns
*Attorney, Agent, or Firm*—Robert D. Farkas

[57] ABSTRACT

A side burn trimming appliance that fits over the head and includes a plurality of removably, adjustable templates having varying shapes that are positionable over the length of the side burn to provide for an even and accurate cut thereof such that both sides of the head will have equally sized and shaped side burns.

7 Claims, 3 Drawing Figures

FIG. 1
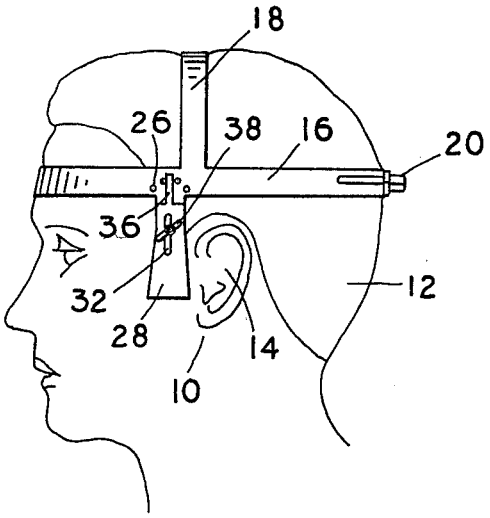
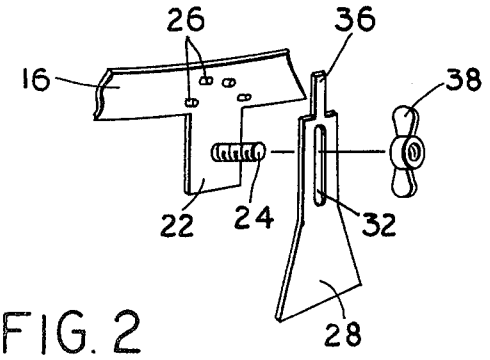
FIG. 2
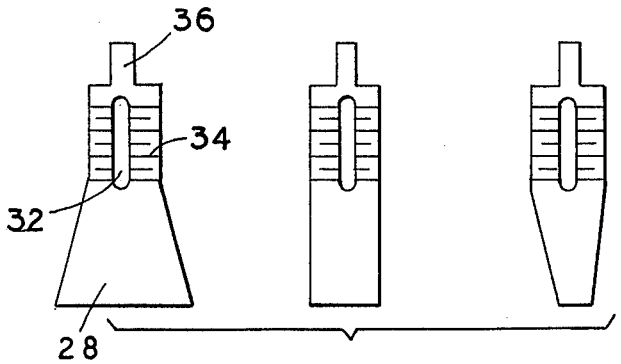
FIG. 3

SIDE BURN TRIMMING GUIDE

BACKGROUND OF THE INVENTION

This invention relates to an appliance to aid in the trimming of side burns; more particularly to an appliance wherein the size of the side burn may be adjusted.

The prior art teaches a variety of hair trimming appliances for example, as disclosed in U.S. Pat. Nos. 1,013,077; 1,329,437; 1,812,443; 2,542,450; 2,698,018; 3,180,341; 3,491,450 and others.

SUMMARY OF THE INVENTION

It is accordingly an object of the instant invention to provide for a new and improved side burn trimming guide.

It is another object to provide for one having the fore-going desirable attributes.

It is a further object to provide for the same at relatively little cost thereby making it generally available.

These and other objects and advantages of the invention will become more apparent from a consideration of the following detailed disclosure and claims and by reference to the accompanying drawing in which:

FIG. 1 is a side elevational view of the device on a head;

FIG. 2 is a perspective view of a portion thereof; and

FIG. 3 is a top plan view of several of the trimming guides.

Broadly speaking, the instant invention includes the provision of a side burn trimming guide appliance, comprising an annular first band circumscribing the head, a pitch controlling second band communicating across the diameter of the first band, an arm depending from the first band, a threaded shaft substantially perpendicular to the arm, a plurality of raised spaced apart protrusions disposed in an arc on the front band above the arm, at least one template removably attachable to the arm, the template defining an aperture, a neck of reduced external diameter on one distal end of the neck, the shaft mating with the aperture, the neck communicating between two of the plurality of protrusions, means engaging the shaft for securing the template thereto.

DETAILED DESCRIPTION OF THE PREFERRED EMBODIMENT

Referring more particularly to the drawings, there is shown a head 10 with hair 12 thereon and the customarily grown side burns (not shown) forward of the ear 14. The instant appliance includes a flexible strap combination that includes a substantially circular strap 16 disposed about the circumference of the head 10 and a pitch stabilizing strap 18 communicating therewith and disposed over the top of the head 10 thus roughly forming a cap shaped combination. In one embodiment, the straps 16, 18, either one or both, may be elastic; in another embodiment, means 20 are provided on the distal ends of strap 16 for fastening the same about the back of the head 10. Suitable means 20 include snaps, clips, buckles, etc. Strap 18 is disposed across the diameter of strap 16 and when the appliance is worn on the head 10 the strap 18 will be in substantial longitudinal alignment with the ear 14. An arm 22 depends from strap 16 just forward of the ear 14 and is preferably flexible though it need not be, though it is substantially perpendicular thereto. Means 24 such as a threaded shaft are disposed perpendicular to arm 22. A plurality of raised members 26 such as rounded protrusions or detents are disposed in an arc about the strap 16 just above the point where the same communicates with arm 22, i.e., forming a semi circle from side to side about the alignment of the arm 22 with the strap 16.

A plurality of side burn trimming templates 28 of varying size and shape are provided to cooperate with the appliance. Each template includes a portion 30 of varying size and shape defining an elongated slit 32 in longitudinal alignment therewith and measurement indicia 34 disposed about the periphery of the slit 32. The slit 32 is of an internal diameter greater than the external diameter of the shaft 24 which mates therewith. A portion 36 of reduced external diameter relative to the portion 28 forms one distal end of the template 28 and is of an external diameter smaller than the space defined between the members 26 such that the same be removably positioned between any two of said members 26, when the template 28 is rotated about the shaft 24 for positionable alignment over the side burn. Means 38 such as an internal threaded nut or a wing nut are provided to lock the template 28 about the shaft 24. The template 28 will be substantially parallel and overlies the arm 22 while the portion 36 will contact the strap 16 and be parallel thereto and at the same time communicate between any two spaced apart members 26.

Since it is obvious that numerous changes and modifications can be made in the above-described details without departing from the spirit and nature of the invention, it is to be understood that all such changes and modifications are included within the scope of the invention.

I claim:

1. A side burn trimming guide appliance, comprising an annular first band circumscribing the head, a pitch controlling second band secured to said first band at diametrically opposed points, an arm depending from said first band, a threaded shaft extending substantially perpendicularly from said arm, a plurality of raised spaced apart protrusions disposed in an arc on said first band above said arm, at least one elongated template removably attachable to said arm, said template defining an aperture, a neck of reduced width being located on one distal end of said template, said shaft mating with said aperture, said neck being dimensioned to be selectively positioned between any adjacent two of said plurality of protrusions to permit angular positioning of said template about said shaft, means engaging said shaft for securing said template to said arm.

2. The appliance as defined in claim 1 wherein at least one of said bands is elastic.

3. The appliance as defined in claim 1 wherein there are a plurality of templates of varying size and shape.

4. The appliance as defined in claim 1 wherein said aperture is elongated and longitudinally aligned with said template.

5. The appliance as defined in claim 1 including means disposed on said first band for adjusting the length thereof.

6. The appliance as defined in claim 1 wherein said means is an internally threaded nut.

7. The appliance as defined in claim 1 wherein said aperture is elongated and said template includes measurement indicia adjacent said aperture.

* * * * *